US012116720B2

(12) United States Patent
Lee et al.

(10) Patent No.: US 12,116,720 B2
(45) Date of Patent: Oct. 15, 2024

(54) CLOTHES HOLDER AND CLOTHES CARE DEVICE COMPRISING SAME

(71) Applicant: SAMSUNG ELECTRONICS CO., LTD., Suwon-si (KR)

(72) Inventors: Junghee Lee, Suwon-si (KR); Yongjie Jin, Suwon-si (KR); Sanggyu Jung, Suwon-si (KR); Byoungyull Yang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 66 days.

(21) Appl. No.: 17/990,905

(22) Filed: Nov. 21, 2022

(65) Prior Publication Data

US 2023/0083469 A1 Mar. 16, 2023

Related U.S. Application Data

(63) Continuation of application No. PCT/KR2021/003323, filed on Mar. 18, 2021.

(30) Foreign Application Priority Data

May 26, 2020 (KR) ..... 10-2020-0062931
Sep. 22, 2020 (KR) ..... 10-2020-0122008

(51) Int. Cl.
*D06F 71/36* (2006.01)
*D06F 71/40* (2006.01)
*D06F 73/00* (2006.01)

(52) U.S. Cl.
CPC ..... *D06F 71/36* (2013.01); *D06F 71/40* (2013.01); *D06F 73/00* (2013.01)

(58) Field of Classification Search
CPC ..... D06F 71/35; D06F 71/40; D06F 73/00; D06F 73/02; D06F 59/00; D06F 59/02;
(Continued)

(56) References Cited

U.S. PATENT DOCUMENTS 2,284,232 A * 5/1942 Richa ..... D06F 71/18 34/437
3,070,268 A * 12/1962 Carpenter ..... D06F 71/16 223/74

(Continued)

FOREIGN PATENT DOCUMENTS

EP 3321414 A1 * 5/2018 ..... D06F 35/00
JP 11-005000 A 1/1999

(Continued)

OTHER PUBLICATIONS

International Search Report issued in International Application No. PCT/KR2021/003323 dated Jul. 5, 2021.

(Continued)

*Primary Examiner* — Ismael Izaguirre
(74) *Attorney, Agent, or Firm* — STAAS & HALSEY LLP

(57) ABSTRACT

A clothes care device comprising a body including a care room that accommodates clothes; and a holder including a base formed to extend in a first direction so as to support the clothes, and a fixing device for fixing the clothes supported on the base. The fixing device may include: a holder body formed to extend in the first direction; a pressing member coupleable to one end of the holder body, and which is rotatable between a first position extending in a second direction for pressing the clothes such that the clothes are fixed, and a second position spaced apart from the pressing member such that the clothes are released; a rotary shaft rotatably coupling the holder body and the pressing member; and an elastic member coupleable to the rotary shaft so as to elastically bias the pressing member to the first position.

15 Claims, 21 Drawing Sheets

(58) Field of Classification Search
CPC ..... A47G 25/16; A47G 25/20; A47G 25/487; A47G 25/72
See application file for complete search history.

(56) References Cited

U.S. PATENT DOCUMENTS

| | | | | | |
|---|---|---|---|---|---|
| 3,184,127 | A * | 5/1965 | Smith | D06F 59/02 | 223/67 |
| 3,960,264 | A | 6/1976 | Carbine et al. | | |
| 4,592,497 | A * | 6/1986 | Georges | F26B 9/003 | 223/69 |
| 4,878,577 | A | 11/1989 | Romero Lledo et al. | | |
| 5,815,961 | A * | 10/1998 | Estes | D06F 73/02 | 38/14 |
| 11,058,244 | B2 | 7/2021 | Langner | | |
| 2015/0020419 | A1* | 1/2015 | Park | D06F 71/30 | 38/3 |

FOREIGN PATENT DOCUMENTS

| | | | | | |
|---|---|---|---|---|---|
| JP | 2000-300896 | A | | 10/2000 | |
| KR | 2012091799 | A | * | 8/2012 | D06F 35/00 |
| KR | 10-2018-0052953 | A | | 5/2018 | |
| KR | 10-2018-0052954 | A | | 5/2018 | |
| KR | 10-2018-0052955 | A | | 5/2018 | |
| KR | 10-2052976 | | | 12/2019 | |

OTHER PUBLICATIONS

International Written Opinion issued in International Application No. PCT/KR2021/003323 dated Jul. 5, 2021.

* cited by examiner

CLOTHES HOLDER AND CLOTHES CARE DEVICE COMPRISING SAME

CROSS-REFERENCE TO RELATED APPLICATIONS

This application is a continuation application, under 35 U.S.C. § 111(a), of International Patent Application No. PCT/KR2021/003323, filed on Mar. 18, 2021, which claims the benefit of Korean Patent Application No. 10-2020-0062931, filed May 26, 2020 and Korean Patent Application No. 10-2020-0122008, filed Sep. 22, 2020, in the Korean Intellectual Property Office, the entire disclosures of each of which are incorporated herein by reference as a part of this application.

BACKGROUND

Field

The present disclosure relates to a clothes care device, and more specifically, to a clothes care device capable of fixing clothes.

Description of Related Art

Clothes care devices are a device which performs clothes care such as drying wet clothes, removing dust attached to clothes or odors ingrained in clothes, and decreasing creases on clothes.

The clothes care devices may include a clothes care room, which is an accommodation space in which clothes are accommodated, and a steam generator for performing refreshing functions such as removing creases, deodorizing, and removing static electricity from clothes.

In general, the clothes care devices may remove fine dust and creases on clothes by supplying steam to the clothes and transmitting a mechanical force through strong airflow or vibration. Alternatively, creases may be removed by a method of holding clothes on a compressor provided inside the clothes care device and then applying a press to a part of the clothes.

However, at this time, not only life creases of clothes may be removed, but also original sharp creases of the clothes may be removed. Accordingly, there is a growing demand for a clothes care device capable of maintaining the sharp creases in recent years.

SUMMARY

A clothes care device according to the idea of the present invention includes a body including a care room configured to accommodate clothes, and a holder including a base configured to support clothes accommodated in the care room and a fixing device configured to fix the clothes while the clothes are supported on the base, wherein the fixing device includes a holder body coupleable to the base and a pressing member rotatably coupleable to the holder body, wherein while the pressing member is coupled to the holder body, the pressing member is movable between a first position at which the pressing member presses the base so that the clothes supported the base are fixed between the pressing member and the base and a second position at which the pressing member is spaced apart from the base so that the clothes are released from between the pressing member and the base.

The holder may further include a head coupleable to and decoupleable from the body.

The clothes care device may include a rotary shaft configured to rotatably couple the holder body and the pressing member and an elastic member coupleable to the rotary shaft to elastically bias the pressing member to the first position.

The clothes care device may further include a contact portion at an end opposite to an end of the pressing member to come into contact with the clothes.

The fixing device may further include a friction member on the contact portion to increase a frictional force when coming into contact with the clothes.

At least a part of the contact portion may include a curved surface to guide the clothes, and the friction member may be on an outer circumferential surface of the contact portion.

The holder body may be disposed on an upper portion of the pressing member, and a center of the rotary shaft may be positioned under a center of the contact portion so as to allow the clothes to be introduced between the holder body and the pressing member.

The clothes care device may further include a door rotatably coupleable to the body to open and close the care room, and the holder may be coupleable to and decoupleable from the door.

The holder may further include a plurality of press members rotatably coupleable to both sides of the base, the plurality of press members being formed to extend along a first direction to apply pressure to the clothes.

The base and the plurality of press members may include magnets to press the clothes.

The holder may further include a plurality of hinge devices, each of the plurality of hinge devices may include a shaft configured to connect the base and one of the plurality of press members, the shaft formed to extend along in a longitudinal direction, a rotation movement member coupleable to the shaft and be rotatable together with the shaft, a linear movement member coupleable to the rotation movement member, the linear movement member being configured to move along the longitudinal direction in response to a rotation of the rotation movement member, and a spring elastically biased to the linear movement member, and the linear movement member may include a cover portion formed to extend along the longitudinal direction of the linear movement member to cover the rotation movement member and an accommodation groove recessed along the longitudinal direction of the linear movement member so that the linear movement member accommodates lubricant.

The clothes care device may further include a holding member inside the care room and configured to hold the clothes, and the holding member may be coupleable to an upper side of the holder.

The holder and the holding member may be rotatably coupleable, and the clothes care device may further include a first rotary member coupleable to a lower side of the holding member, and a second rotary member coupleable to the first rotary member on the upper side of the holder.

The first rotary member may include a first rotary base, and a first mounting portion formed to protrude downward from the first rotary base, the second rotary member may include a second rotary base, and a second mounting portion formed to protrude upward from the second rotary base to be coupleable to the first mounting portion, and the first mounting portion and the second mounting portion may be provided in shapes corresponding to each other.

The fixing device may be adjacent to a clothes supporter configured to support the clothes on the base, and a lower portion of the base may include a stepped portion recessed in a second direction to prevent creases of the clothes.

The clothes care device may further include a support device equipped with the head of the holder so that the holder is disposed in the care room, and the head may include a mounting groove mounted on the support device.

A clothes holder according to the idea of the present invention includes a base, a holder body coupleable to the base, and a pressing member rotatably coupleable to the holder body, wherein the base and the holder body may be disposed at an interval, one end of the pressing member may be biased to press the base by the rotation of the pressing member, a rotary shaft of the pressing member may be disposed between the base and the holder body, and one end of the pressing member may be disposed between the rotary shaft of the pressing member and the base.

The clothes care device may further include a rotary shaft configured to rotatably couple the holder body and the pressing member and an elastic member coupleable to the rotary shaft to elastically bias the pressing member.

The clothes care device may further include a contact portion at an end opposite to an end of the pressing member to come into contact with the clothes.

At least a part of the contact portion may include a curved surface to guide the clothes, and the clothes care device may further include a friction member on an outer circumferential surface of the contact portion to increase a frictional force when coming into contact with the clothes.

The holder body may be on an upper portion of the pressing member, and a center of the rotary shaft may be positioned under a center of the contact portion so that the clothes enter between the holder body and the pressing member.

DETAILED DESCRIPTION

Figure 1:
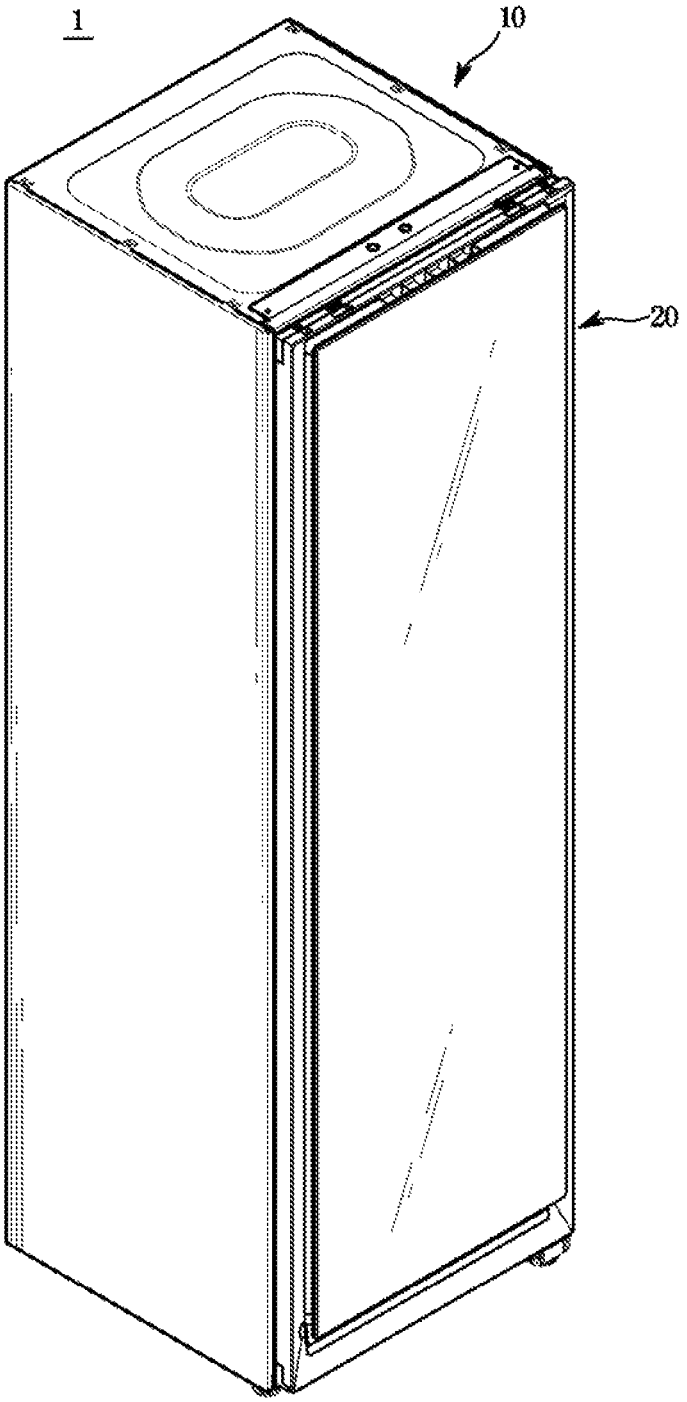
FIG. 1 is a view showing a clothes care device according to one embodiment of the present invention.

A configuration shown in the embodiments and drawings described in this specification is only an exemplary example of the disclosed invention, and there may be various modified examples which may replace the embodiments and drawings of this specification at the time of filing of this application.

In addition, the same reference numerals or symbols presented in each drawing in this specification indicate parts or components which perform substantially the same functions.

In addition, the terms used herein are used to describe the embodiments, and are not intended to limit and/or restrict the disclosed invention. A singular expression includes a plural expression unless the context clearly dictates otherwise. In this specification, the term such as "comprise" or "have" is intended to specify that the features, numbers, steps, operations, components, parts, or combinations thereof described in the specification exist, and does not preclude the possibility of the presence or addition of one or more other features, numbers, steps, operations, components, parts, or combinations thereof in advance.

In addition, terms including an ordinal number such as "first" and/or "second" may be used to describe various components, but the components are not limited by the terms, and the terms are used only for the purpose of distinguishing one component from other components. For example, a first component may be named as a second component, and similarly, the second component may also be named as the first component without departing from the scope of the present invention. The term "and/or" includes a combination of a plurality of related listed items or any of a plurality of related listed items.

Meanwhile, the terms "front", "rear", "left", "right", and the like used in the following description are defined based on the drawings, and the shape and position of each component is not limited by these terms.

Hereinafter, embodiments according to the present invention will be described in detail with reference to the accompanying drawings.

The present invention is directed to providing a clothes care device including an improved holder to remove life creases of clothes while clearly maintaining original sharp creases.

The present invention is directed to providing a clothes care device including a holder separably mounted on a body.

The present invention is directed to providing a clothes care device including a holder rotatably coupled to a clothes holding member.

According to an embodiment of the present invention, it is possible to clearly manage original sharp creases of clothes while removing life creases.

According to an embodiment of the present invention, it is possible to increase the usability of an internal space of a clothes care device by providing a clothes holder mounted separably.

According to an embodiment of the present invention, it is possible to manage both tops and bottoms by providing a holder rotatably coupled to a clothes holding member.

Figure 2:
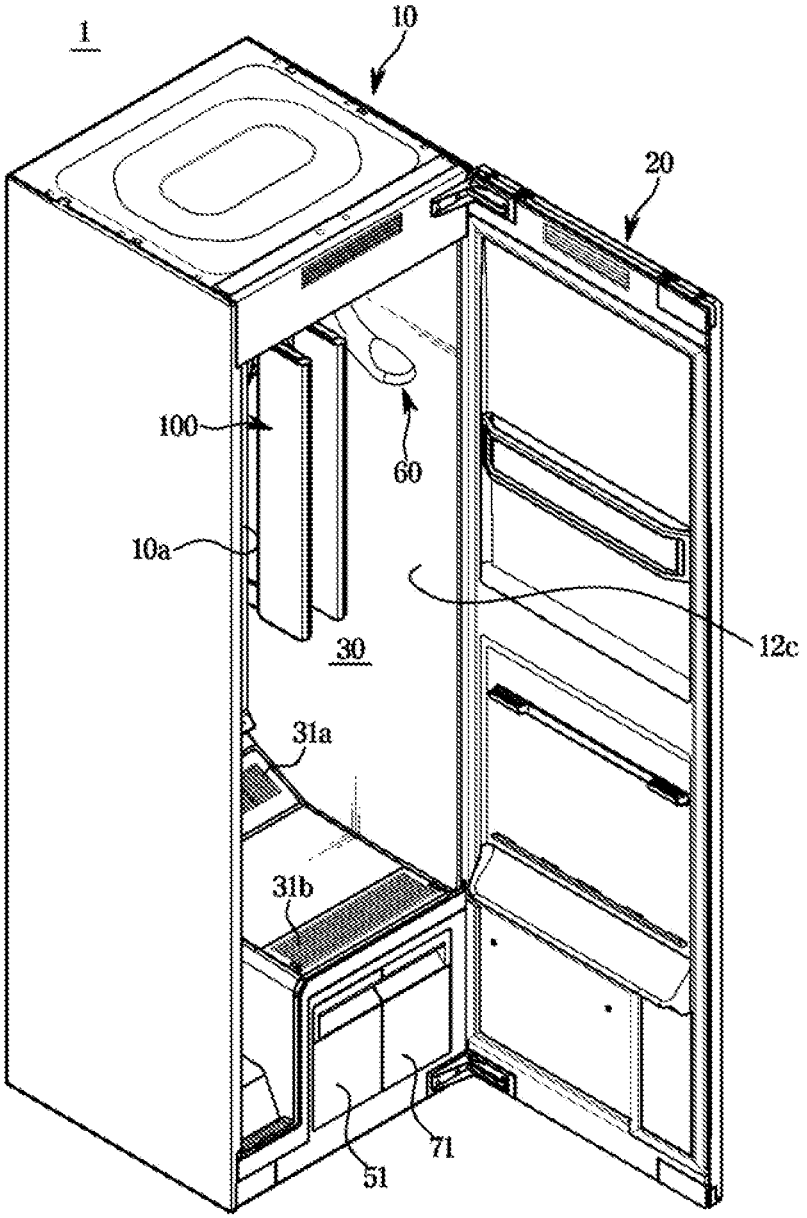
FIG. 2 is a view showing a state in which a door is opened in the clothes care device shown in FIG. 1 according to an embodiment of the present invention.
Figure 3:
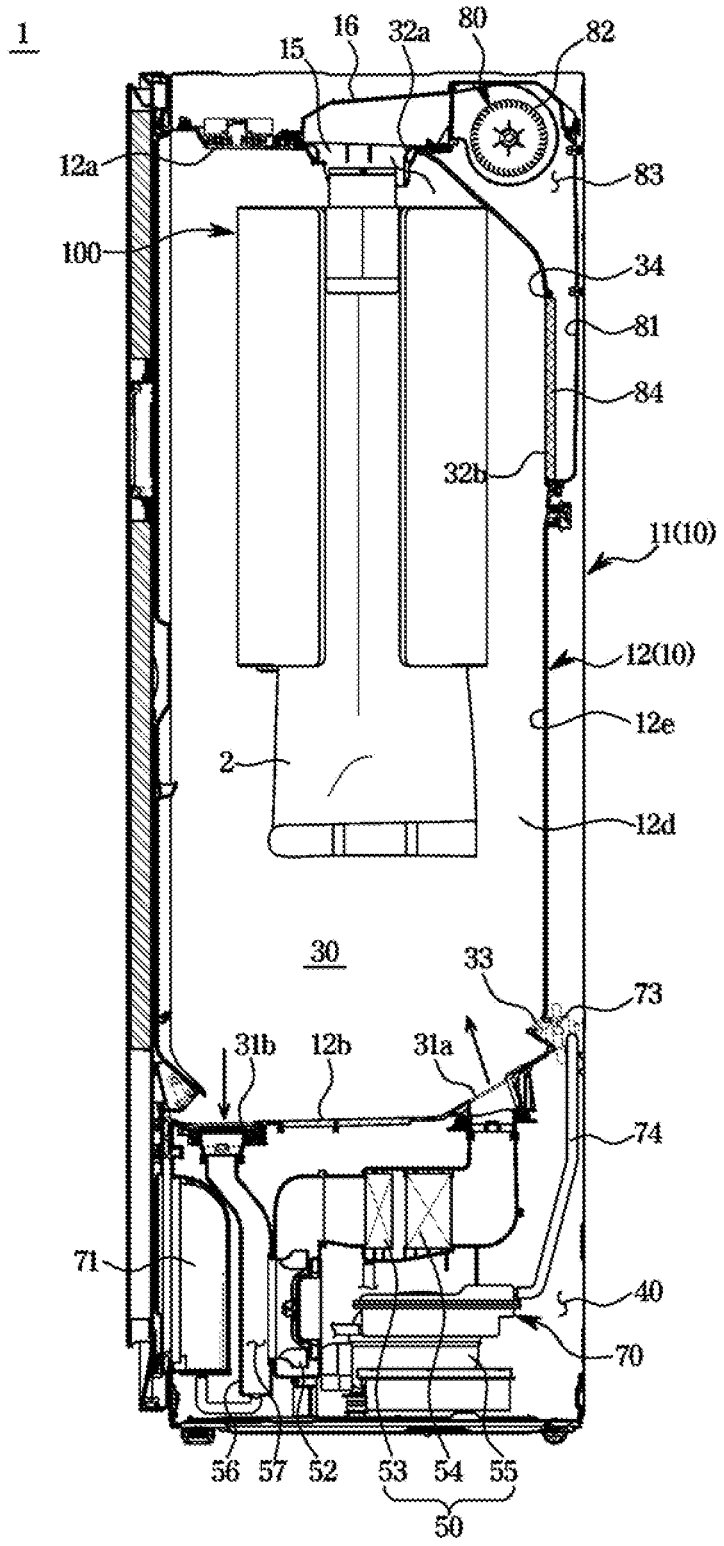
FIG. 3 is a side cross-sectional view of the clothes care device shown in FIG. 1 according to an embodiment of the present invention.

FIG. 1 is a view showing a clothes care device according to one embodiment of the present invention. FIG. 2 is a view showing a state in which a door is opened in the clothes care device shown in FIG. 1. FIG. 3 is a side cross-sectional view of the clothes care device shown in FIG. 1.

As shown in FIGS. 1 to 3, a clothes care device 1 may include a body 10 forming an exterior and a door 20 rotatably coupled to the body 10.

The body 10 may have a substantially hexahedral shape with one open surface. An opening 10*a* may be formed on a front surface of the body 10. The body 10 may be equipped with the door 20 rotatably coupled and configured to open and close a care room 30.

Although not shown in the drawings, the door 20 may be installed on the body 10 through a hinge, a link, or the like.

The body 10 may include the care room 30 provided inside the body 10 and configured to accommodate and take care of clothes. A front surface of the care room 30 may be formed to be open 10*a*. The care room 30 may also be opened and closed by the door 20 configured to open and close the opening 10*a*.

As shown in FIGS. 2 and 3, the body 10 may include an outer cabinet 11 and an inner cabinet 12 disposed inside the outer cabinet 11. The body 10 may include a support device 15 provided inside the care room 30 and provided to hold a holding member 60 or a holder 100.

The body 10 may include a machine room 40 provided with a heat exchange device 50 provided to dehumidify or heat air inside the care room 30 and the like.

The care room 30 may form a space in which clothes 2 are accommodated. The care room 30 may include an upper surface 12*a*, a lower surface 12*b*, a left surface 12*c*, a right surface 12*d*, and a rear surface 12*e* provided in the inner cabinet 12.

The inner cabinet 12 may include a frame (not shown) provided to support the upper surface 12*a*, the lower surface 12*b*, the left surface 12*c*, the right surface 12*d*, and the rear surface 12*e*.

The frame (not shown) may form the care room 30 and the machine room 40 disposed under the care room 30. However, the present invention is not limited thereto.

The support device 15 may be installed on the upper surface 12*a* of the care room 30. The support device 15 may hold the holding member 60 configured to hold the clothes and the holder 100 configured to take care of creases of the clothes 2.

The holding member 60 may be installed separably from the support device 15. At least one holding member 60 may be provided. The holding member 60 may be formed in a shape of a hanger so that clothes may be fitted thereto. However, the present invention is not limited thereto.

The holding member 60 may be provided so that air flows therein. Dust or foreign substances attached to the clothes may be removed by the air supplied to the inside of the holding member 60.

The holding member 60 may be formed with an air hole configured to supply air to the clothes. The air hole may be formed at an upper end of the holding member 60, and the air may be supplied to the clothes through the air hole.

However, the present invention is not limited thereto, and the air hole may be formed in various sizes at various positions to widely spray the supplied air to the clothes.

The care room 30 may include a first outlet 31*a* and a second outlet 32*a*, a first inlet 31*b* and a second inlet 32*b*, and a steam outlet 33.

The first outlet 31*a* and the first inlet 31*b* may be formed on the lower surface 12*b* of the care room 30. The first outlet 31*a* may be disposed behind the lower surface 12*b* of the care room 30. The first inlet 31*b* may be disposed in front of the lower surface 12*b* of the care room 30. The first outlet 31*a* and the first inlet 31*b* may be disposed at positions adjacent to each other.

The steam outlet 33 may be disposed under the rear surface 12*e* of the care room 30. The steam outlet 33 may be disposed above the first outlet 31*a*.

The second outlet 32*a* may be formed above the upper surface 12*a* of the care room 30. The second inlet 32*b* may be formed on a center of the rear surface 12*e* of the care room 30. The second outlet 32*a* and the second inlet 32*b* may be disposed at positions adjacent to each other.

The second outlet 32*a* of the care room 30 may be connected to the holding member 60. The air discharged through the second outlet 32*a* may be transmitted to the holding member 60 through the air hole and transmitted to the clothes held on the holding member 60.

A water drain tank 51 and a water supply tank 71 which are provided separably from the body 10 may be installed on a lower portion of the body 10. The water drain tank 51 and the water supply tank 71 may be disposed on a lower portion of the care room 30.

The water drain tank 51 may be provided to facilitate condensed water treatment by the heat exchange device 50. The water supply tank 71 may store water required to generate steam in a first steam generation device 70.

The water in the water supply tank 71 may be supplied to the first steam generation device 70 and used to form steam. The water supply tank 71 may be installed separably from the body 10 to facilitate water replenishment.

The water drain tank 51 and the water supply tank 71 may be provided in front of the machine room 40. The machine room 40 may be provided on a lower side of the body 10. The machine room 40 may be provided under the care room 30.

A plurality of hoses may be provided, and the plurality of hoses may be used for each of the heat exchange device 50 and the first steam generation device 70.

The heat exchange device 50 may be provided to dehumidify and heat the air inside the care room 30 as necessary.

The heat exchange device 50 may be installed to supply hot air to the inside of the care room 30. The heat exchange device 50 may include an evaporator 53, a condenser 54, and a compressor 55 through which refrigerant circulates, and may be provided to dehumidify and heat the air.

As the refrigerant evaporates in the evaporator 53 of the heat exchange device 50, the latent heat of the surrounding air is absorbed, so that it is possible to condense and remove moisture in the air.

When the refrigerant is condensed in the condenser 54 by passing through the compressor 55, the surrounding air may be heated by discharging the latent heat toward the surrounding air.

The evaporator 53 and the condenser 54 perform a heat exchange function, so that the air introduced into the machine room 40 by a first fan 52 may sequentially pass through the evaporator 53 and the condenser 54 and may be dehumidified and heated.

The heat exchange device 50 installed in the machine room 40 may include a first duct 56 configured to connect the evaporator 53, the condenser 54, and the first fan 52, and the first duct 56 may be connected to the care room 30 to form a first flow path 57 which circulates between the care room 30 and the first duct 56.

The first duct 56 may be connected to the first outlet 31*a* and the first inlet 31*b* of the care room 30. One end of the first duct 56 may be connected to the first outlet 31*a*, and the other end thereof may be connected to the first inlet 31*b*.

The air in the care room 30 may be introduced into the first duct 56 through the first inlet 31*b*, and the introduced air may be dehumidified and discharged back to the care room 30 through the first outlet 31*a*.

The first outlet 31*a* may be disposed at the rear of the care room 30, and the first inlet 31*b* may be disposed at the front of the care room 30. However, the present invention is not limited thereto. The positions of the first outlet 31*a* and the first inlet 31*b* may be variously changed as necessary.

The first duct 56 may be provided to dehumidify the air introduced through the first inlet 31*b* and discharge the dehumidified air to the first outlet 31*a*. The first fan 52 may be provided on the first duct 56 and provided to suck the air in the care room 30 to the inside of the first duct 56.

The machine room 40 may be provided with the first steam generation device 70 configured to receive water from the water supply tank 71 to form steam.

The first steam generation device 70 may be connected to the water supply tank 71 to receive water and generate steam, and may include a steam supply tube 74 configured to guide the generated steam to a steam sprayer 73. The steam sprayer 73 may be disposed on a lower portion of the rear surface 12*e* of the care room 30.

The steam sprayer 73 may have a nozzle-shaped tip so as to smoothly spray steam into an internal space of the care room 30, and may be installed to be exposed to the inside of the care room 30.

The care room 30 may include a blowing device 80 configured to flow the air inside the care room 30. The blowing device 80 may include a second duct 81, and a second fan 82 may be installed inside the second duct 81.

The second duct 81 may be provided to communicate with the care room 30 to form a second flow path 83 which circulates between the care room 30 and the second duct 81. The second fan 82 may be disposed on the second flow path 83.

The second duct 81 may be formed behind the second inlet 32*b* of the care room 30. The second duct 81 may be provided on an upper side of the rear surface 12*e* of the care room 30, and may include a filter 84 therein.

The filter 84 may include a high efficiency particulate air (HEPA) filter 84. However, the present invention is not limited thereto.

The second duct 81 may be coupled to a top cover 16 disposed on an upper portion of the care room 30. The blowing device 80 may be disposed at the rear of the upper portion of the care room 30, and may include a motor (not shown) configured to generate a rotational force and at least one second fan 82 rotated by the motor (not shown).

A pair of second fans 82 may be provided as a centrifugal fan configured to suck air in an axial direction and discharge the air outward in a radial direction. However, the present invention is not limited thereto.

The second duct 81 may be connected to the second outlet 32*a* and the second inlet 32*b* of the care room 30. One end of the second duct 81 may be connected to the second outlet 32*a*, and the other end thereof may be connected to the second inlet 32*b* of the care room 30.

The second outlet 32*a* may be connected to the holding member 60 so that the air of the second duct 81 may be transmitted to the holding member 60.

The second fan 82 disposed inside the second duct 81 may be provided to introduce the air inside the care room 30 through the second inlet 32*b* and discharge the introduced air to the second outlet 32*a*.

A filter installation portion 34 configured to install the filter 84 may be provided on the rear surface 12*e* of the care room 30. The second inlet 32*b* may be formed at a position corresponding to the filter installation portion 34.

When introduced into the second duct 81, the air inside the care room 30 may be filtered by the filter 84 of the second inlet 32*b*. Dust and odors in the air introduced into the second duct 81 may be removed by the filter 84.

The air filtered by the filter 84 may be discharged to the holding member 60 through the blowing device 80. The filter 84 may include a dust collection filter (not shown) configured to remove dust or a means for deodorizing.

When taking care of clothes, the care room 30 may be operated in a state in which the clothes are held on the holding member 60 and the door 20 is closed. In the care room 30, air may be circulated along the first flow path 57 and the second flow path 83.

Figure 4:
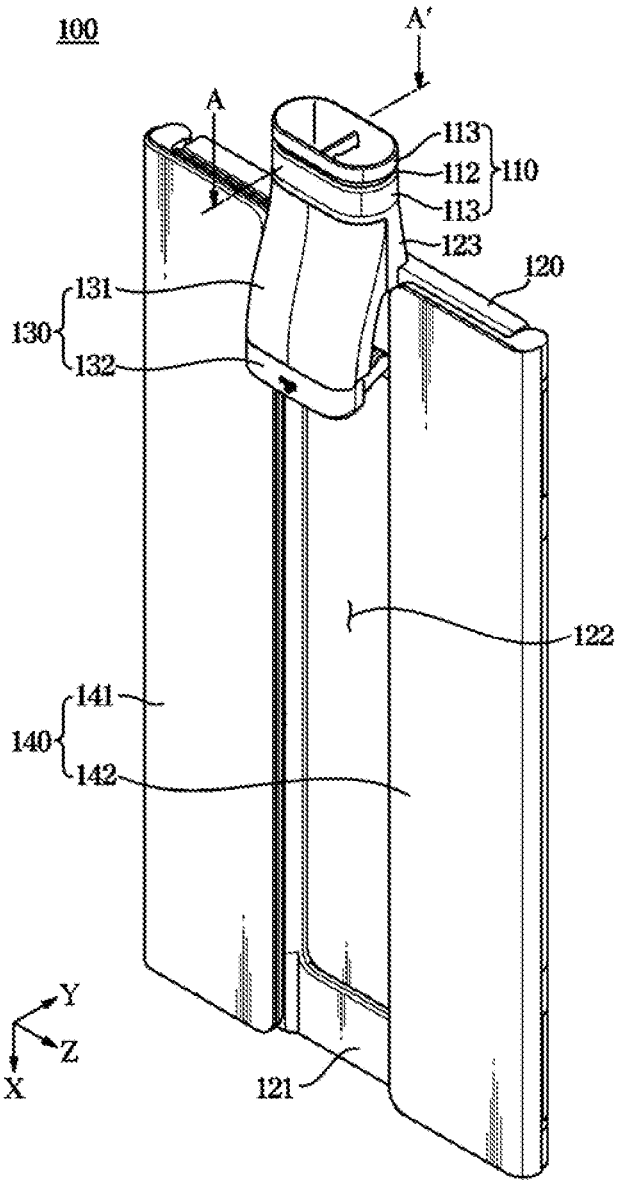
FIG. 4 is a perspective view showing a clothes holder in the clothes care device shown in FIG. 1 according to an embodiment of the present invention.
Figure 5:
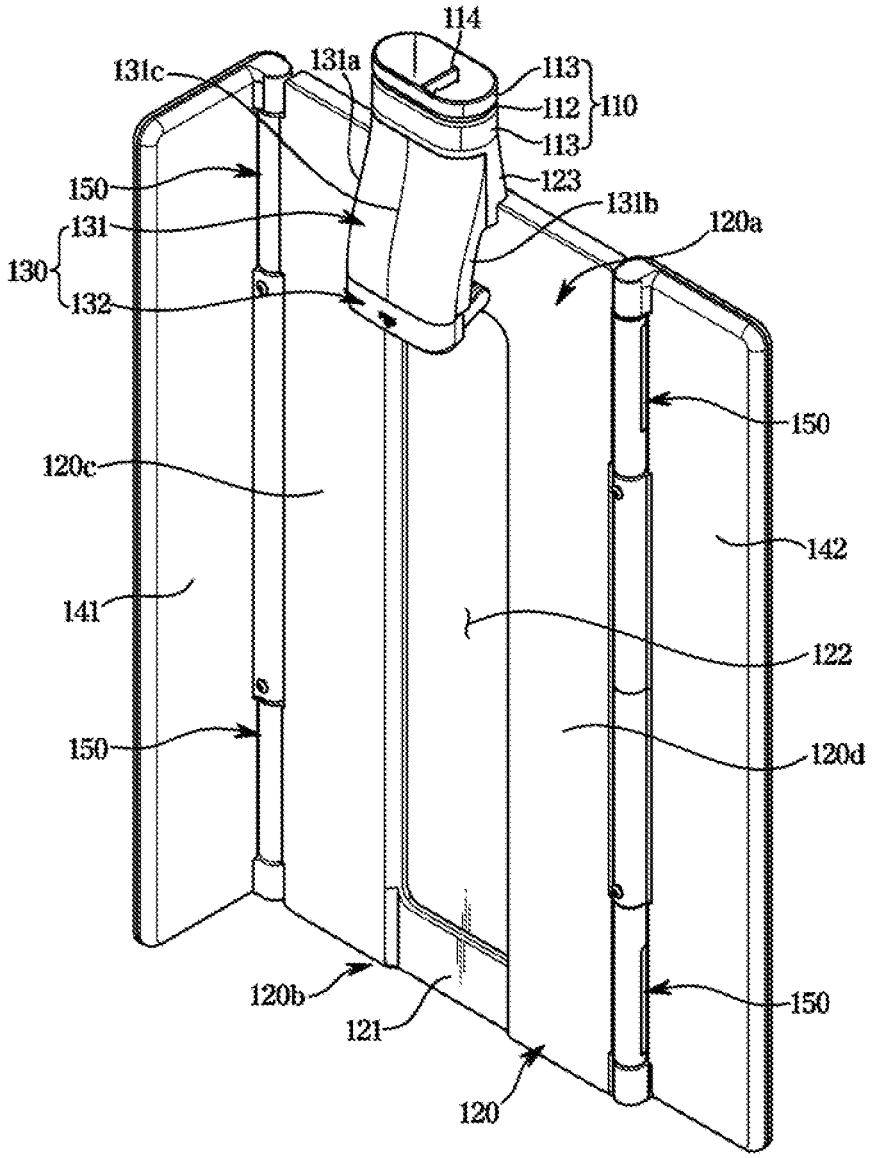
FIG. 5 is a view showing a state in which a plurality of press members are opened in the holder shown in FIG. 4.

FIG. 4 is a perspective view showing a clothes holder in the clothes care device shown in FIG. 1. FIG. 5 is a view showing a state in which a plurality of press members are opened in the holder shown in FIG. 4.

Hereinafter, descriptions of parts overlapping the above description will be omitted. In addition, FIGS. 4 and 5 are views showing the holder 100 separated from the clothes care device, and a second direction may be a front-rear direction and a third direction may be a left-right direction.

Referring to FIGS. 4 and 5, the holder 100 may include a head 110, a base 120, and a fixing device 130.

The head 110 may be positioned above the base 120 and the fixing device 130. The head 110 may be separably coupled to the body 10. Accordingly, a user may couple the holder 100 to the body 10 or couple the holding member as necessary. Accordingly, it is possible to increase the space utilization within the care room 30.

The head 110 may include a mounting groove 112 and a connector 113.

The mounting groove 112 may allow the holder 100 to be coupled to the body 10 of the clothes care device. In other words, the mounting groove 112 may be coupled to a mounting protrusion (not shown) provided on the support device 15. Accordingly, the user may couple or separate the holder 100 to or from the body 10 as necessary.

The connector 113 may be provided above and under the mounting groove 112. In other words, a plurality of connectors 113 may be provided. The connector 113 may extend vertically from the mounting groove 112 so that the head 110, the base 120, and the fixing device 130 are connected. In the drawing, a shape of the connector 113 is shown as being an elliptical column but is not limited thereto and may be variously formed.

The base 120 may extend in a first direction X to support clothes in a second direction Y. In other words, the base 120 may vertically extend. The base 120 may include an upper portion 120*a*, a lower portion 120*b*, a left portion 120*c*, and a right portion 120*d*. The upper portion 120*a* may be a clothes supporter 120*a* configured to support clothes.

A hollow portion 122 may be formed between the upper portion 120*a* and the lower portion 120*b* of the base 120. The hollow portion 122 may be formed between the left portion 120*c* and the lower portion 120*b*. In other words, the hollow portion 122 may be formed on a central portion of the base 120. The hollow portion 122 may prevent a portion of the clothes having a large area from creasing when the clothes are fixed to the pressing member 132. In the drawing, a shape of the hollow portion 122 is shown as being a rectangle but is not limited thereto and may include various shapes.

A stepped portion 121 may be provided on the lower portion 120*b* of the base 120. The stepped portion 121 may have a step difference dl with each of the left portion 120*c* and the right portion 120*d* between the left portion 120*c* and the right portion 120*d*. The stepped portion 121 may prevent creases from being formed on a portion of the clothes having the largest area when the clothes are fixed to the pressing member 132.

The base 120 may further include a body coupler 123 coupled to a holder body 131. The body coupler 123 may be disposed under the head 110 and may extend to the clothes supporter 120*a*.

The fixing device 130 may include the holder body 131 and the pressing member 132.

The holder body 131 may extend from the head 110 in the first direction X. The holder body 131 may be coupled to the pressing member 132 at one end extending in the first direction X. In other words, the holder body 131 may be coupled to the body coupler 123.

The holder body 131 may include a curved surface. However, a shape of the holder body 131 is not limited thereto.

The holder body 131 has a left end 131*a* extending from a left end of a central portion 131*c* in the second direction Y, and a right end 131*b* extending from a right end of the central portion 131*c* in the second direction Y. Due to the left end 131*a* and the right end 131*b*, the movement of the pressing member 132 to be described below may be more easily guided.

The pressing member 132 may be rotatably coupled to one end 132*a* of the holder body 131 to extend in the second direction Y. The pressing member 132 may allow the clothes supported by the base 120 to be fixed. A position at which the pressing member 132 extends in the second direction Y to fix the clothes may be a first position P1. In other words, at the first position P1, since the other end of the pressing member 132 and the base 120 are close to each other, the clothes may be fixed.

The pressing member 132 may press the clothes in a direction toward the base 120.

The pressing member 132 may rotate to allow the clothes to be inserted or removed. In other words, the pressing member 132 may move the clothes by increasing a distance between the other end 132*b* of the pressing member 132 and the base 120.

The pressing member 132 is not limited to this embodiment and may include various embodiments such as a holding arm, a clamp, and a clip.

The body coupler 123 may extend vertically between the head 110 and the base 120.

The holder 100 may further include a plurality of press members 140. The plurality of press members 140 may be coupled to the base 120 at both ends of the base 120. The plurality of press members 140 may remove life creases by pressing the fixed clothes and allow sharp creases to be formed on pants. The type of clothes is not limited to pants.

The plurality of press members 140 and the base 120 may be made of a magnetic material so that an attractive force acts on each other. In other words, the plurality of press members 140 and the base 120 may include magnets. Accordingly, the attractive force between the plurality of press members 140 and the base 120 acts to remove life creases and clearly form sharp creases.

The plurality of press members 140 may include a first press member 141 and a second press member 142.

The first press member 141 may be coupled to the base 120 at a left end of the base 120, and the second press member 142 may be coupled to the base 120 at a right end of the base 120.

The holder 100 may further include a plurality of hinge devices 150. The plurality of hinge devices 150 may allow the plurality of frame members to be coupled to the base 120. In the drawing, four hinge devices 150 are shown but the present invention is not limited thereto, and three or less or five or more hinge devices 150 may be provided.

Figure 6:
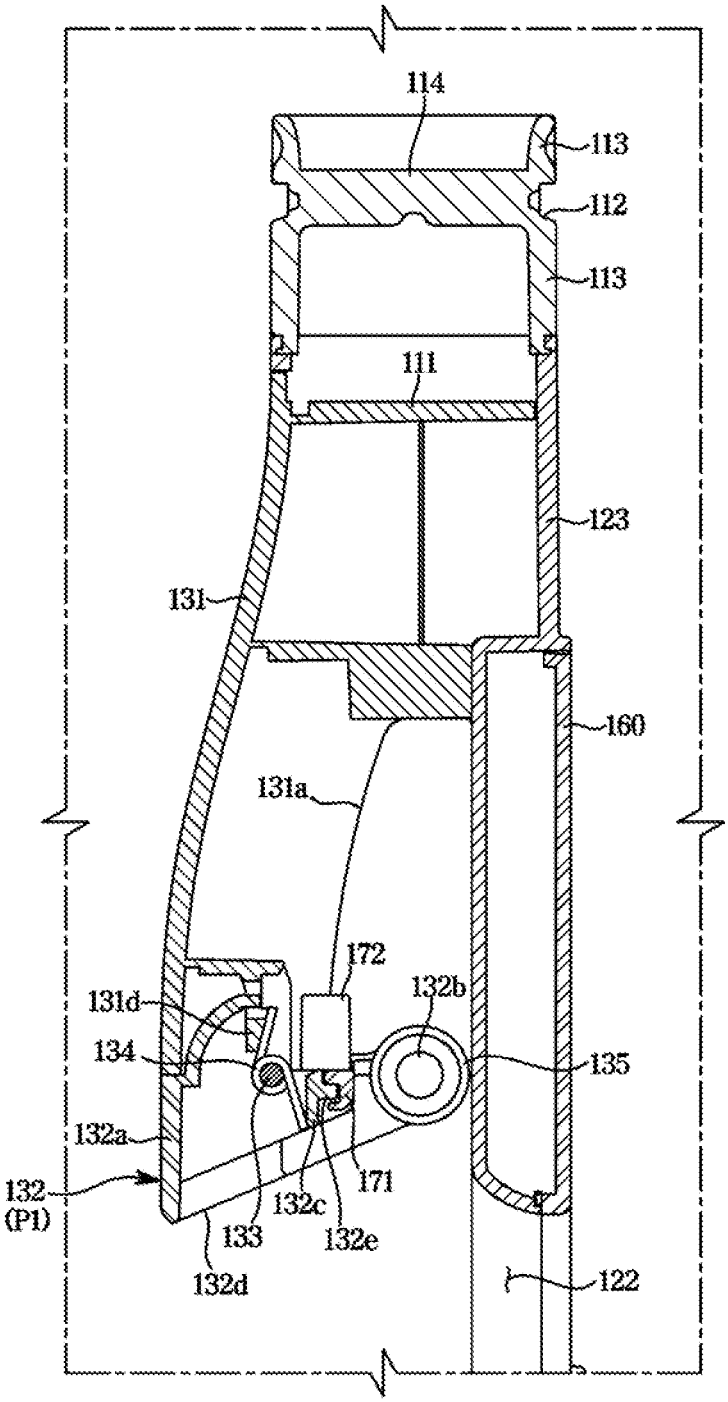
FIG. 6 is a side cross-sectional view of the holder shown in FIG. 4 taken along line A-A' according to an embodiment of the present invention.
Figure 7:
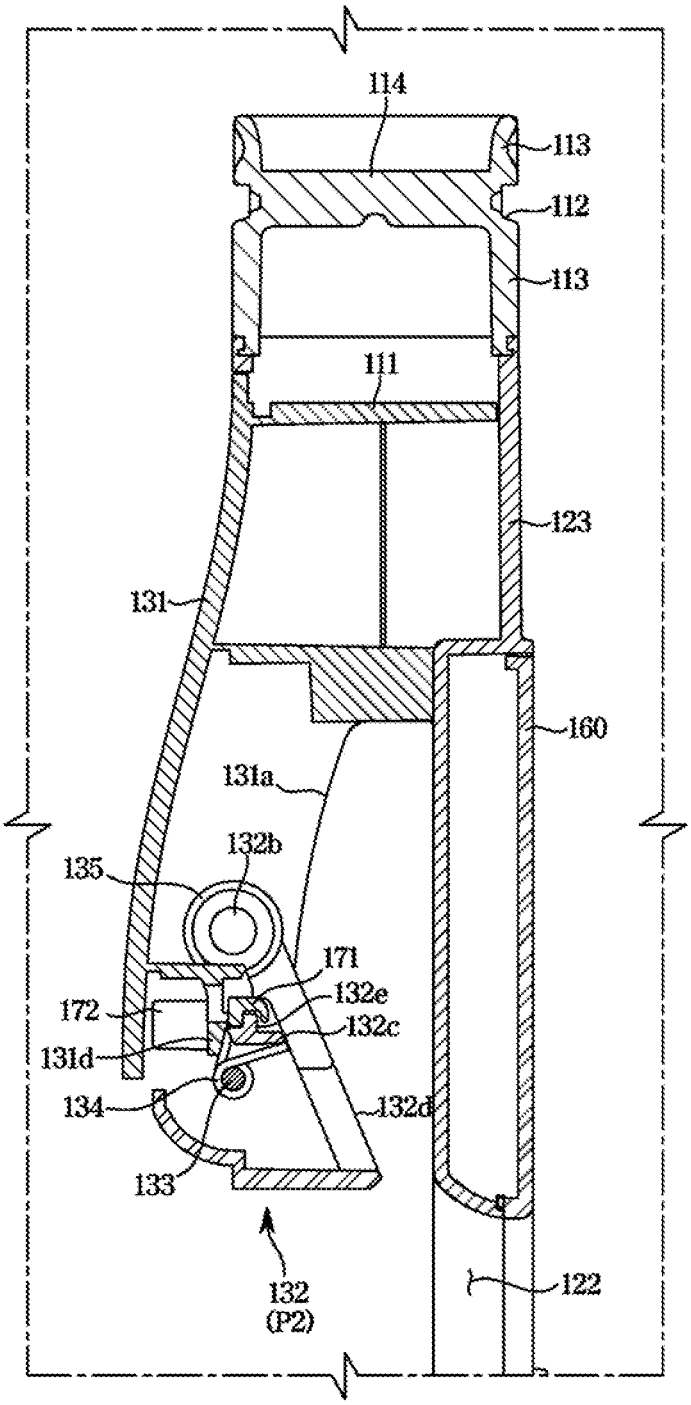
FIG. 7 is a side cross-sectional view of a state in which a pressing member of the holder shown in FIG. 6 is rotated according to an embodiment of the present invention.

FIG. 6 is a side cross-sectional view of the holder shown in FIG. 4 taken along line A-A'. FIG. 7 is a side cross-sectional view of a state in which a pressing member of the holder shown in FIG. 6 is rotated. FIG. 6 is a case in which the pressing member is disposed at the first position P1, and FIG. 7 is a case in which the pressing member is disposed at a second position P2.

Referring to FIGS. 6 and 7, the head 110 may further include a blocking member 111. The blocking member 111 may block the air discharged from the second outlet 32*a* from being introduced into the inside of the fixing device 130 when the body 10 and the holder 100 are coupled.

The one end 132*a* of the pressing member 132 coupled to the holder body 131 may be a coupling portion 132*a*. The other end 132*b* of the pressing member 132 provided adjacent to the base 120 may be a contact portion 132*b*. The contact portion 132*b* may come into contact with the clothes when the clothes are inserted so that the clothes are fixed thereto.

The contact portion 132*b* may include a curved surface. However, the entire contact portion 132*b* may also be formed to have a curved surface, and only a part of the contact portion 132*b* may also be formed to have the curved shape. Since the contact portion 132*b* is formed to have the curved surface, the entry of the clothes may be guided. In other words, the clothes may be easily inserted and removed due to the curved surface. However, a shape of the contact portion 132*b* is not limited to the curved surface and may include various shapes as long as it may easily fix or move the clothes.

The fixing device 130 may further include a rotary shaft 133, an elastic member 134, and a friction member 135.

The rotary shaft 133 may extend in a third direction Z so that the holder body 131 and the pressing member 132 are coupled. The rotary shaft 133 may rotatably couple the holder body 131 and the pressing member 132. A center of the rotary shaft 133 may be provided under a center of the contact portion 132*b*. Accordingly, the pressing member 132 rotates to allow the clothes to enter between the holder body 131 and the pressing member 132.

The rotary shaft 133 may be disposed on a side farther from the base 120 than one end of the pressing member 132. The rotary shaft 133 may be disposed under one end of the pressing member 132. Accordingly, the pressing member 133 may be rotated when the clothes are entered and removed.

The elastic member 134 may be coupled to the rotary shaft 133. In other words, the elastic member 134 may be coupled to an outer circumferential surface of the rotary shaft 133. Ends of the elastic member 134 may be fixed to a latching portion 131*d* of the holder body 131 and a latching protrusion 132*c* of the pressing member 132. Accordingly, when the rotary shaft 133 receives a compressive force upon rotation, the force may act to be elastically biased to the first position P1. Accordingly, even when a user does not arbitrarily operate the pressing member 132, the pressing member 132 may return to the first position P1 after the clothes are inserted and removed. In other words, the clothes may be better fixed, and convenience may be provided to the user.

The friction member 135 may be provided on an outer circumferential surface of the contact portion 132*b*. In other words, the friction member 135 may be formed in a circular shape or a curved shape. However, the present invention is not limited thereto. The friction member 135 may come into contact with the clothes to prevent the clothes from being removed from the first position P1. However, the friction member 135 is not an essential component for achieving the object of the present invention and may be omitted. In other words, the clothes may be fixed at the first position P1 even without the friction member 135.

The pressing member 132 may further include the latching protrusion 132*c*, an inclined portion 132*d*, and a fastening protrusion 132*e*.

The latching protrusion 132*c* may extend in the first direction X. The latching protrusion 132*c* may limit the movement of the elastic member 134 so that a compressive force is formed on the elastic member 134 together with the latching portion 131*d*.

The pressing member 132 may include the inclined portion 132*d* which moves upward from the coupling portion 132*a* to the contact portion 132*b* in the second direction Y. In other words, since the center of the contact portion 132*b* is positioned above a center of the rotary shaft 133, the pressing member 132 may be provided with the inclined portion 132*d*.

The fastening protrusion 132*e* may protrude in the second direction Y to be coupled to a fastening groove 171 of a fastening member 170. The fastening protrusion 132*e* and the fastening groove 171 may be coupled so that the fastening member 170 and the pressing member 132 may rotate together.

The holder 100 may further include the fastening member 170. The fastening member 170 may further include the fastening groove 171 and a fastening cover 172. The fastening cover 172 may cover a fastener (not shown) configured to allow the fastening member 170 and the pressing member 132 to be coupled. The fastening member 170 may be coupled to the pressing member 132 and configured to prevent the rotary shaft 133 from being separated to the outside.

The holder 100 may further include a coupling member 160. The coupling member 160 may be coupled to the base 120 and configured to support the base 120. In addition, a strength of the holder 100 may be increased.

As shown in FIG. 7, when the pressing member 132 rotates to the second position P2, the pressing member 132 and the base 120 may be further spaced apart from each other at the second position P2 than at the first position P1.

Figure 8:
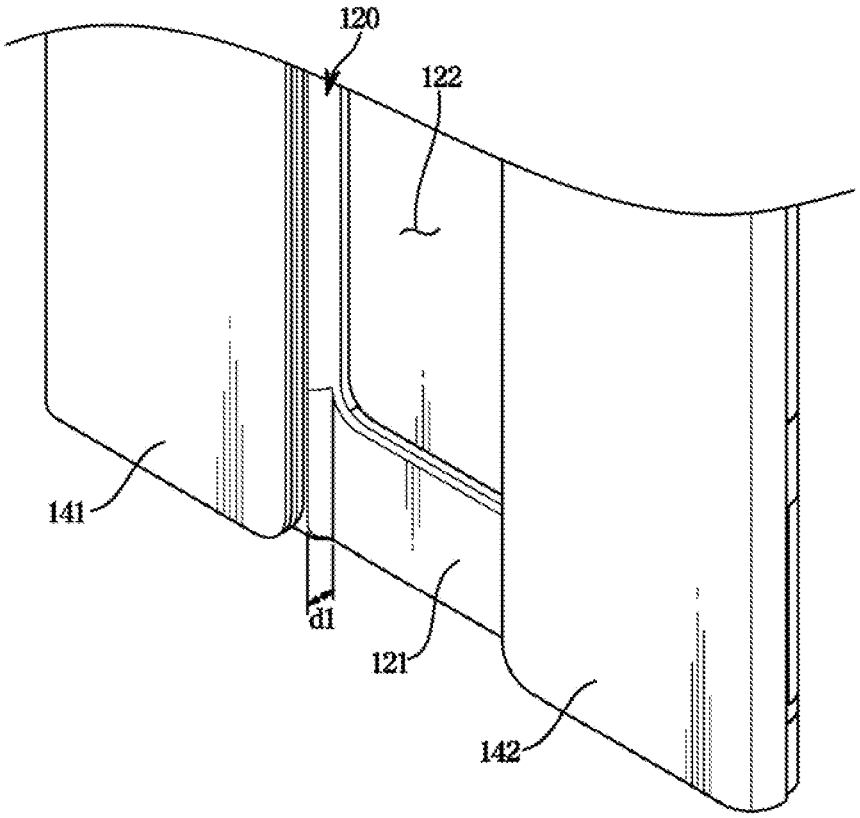
FIG. 8 is a view showing a lower portion of the holder shown in FIG. 4 according to an embodiment of the present invention.

FIG. 8 is a view showing a lower portion of the holder shown in FIG. 4.

Referring to FIG. 8, the lower portion 120*b* of the base 120 may include the stepped portion 121. The stepped portion 121 may include the step difference dl in the second direction Y between the left portion 120*c* and the right portion 120*d*. The stepped portion 121 may prevent creases from being formed on the portion of the clothes having the largest area when the clothes are fixed to the pressing member 132.

Figure 9:
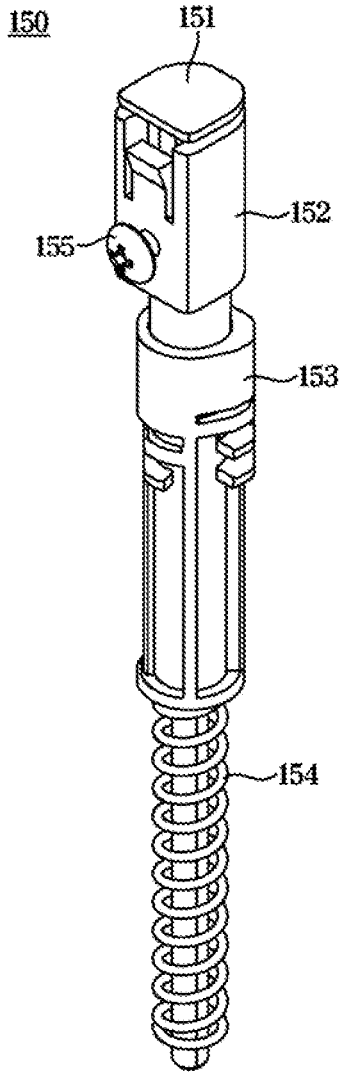
FIG. 9 is a perspective view showing a hinge device in the holder shown in FIG. 4 according to an embodiment of the present invention.
Figure 10:
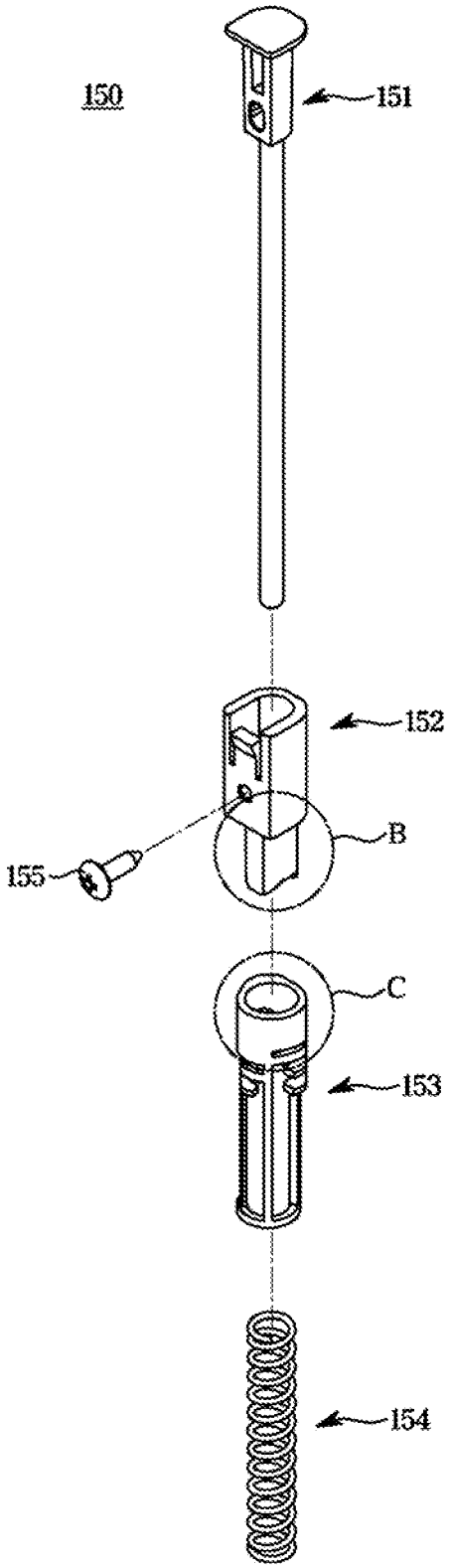
FIG. 10 is an exploded view of the hinge device shown in FIG. 9 according to an embodiment of the present invention.

FIG. 9 is a perspective view showing the hinge device 150 in the holder 100 shown in FIG. 4. FIG. 10 is an exploded view of the hinge device 150 shown in FIG. 9.

Referring to FIGS. 9 and 10, each of the plurality of hinge devices 150 may include a shaft 151, a rotation movement member 152, a linear movement member 153, a spring 154, and a fixing fastener 155.

The shaft 151 may extend in the first direction X, which is a longitudinal direction, to connect the base 120 and one of the plurality of press members 140. The shaft 151 may allow all of the rotation movement member 152, the linear movement member 153, and the spring 154 to be coupled.

The shaft 151 and the fixing fastener 155 may be coupled to the rotation movement member 152. In other words, the shaft 151 may be coupled to the rotation movement member 152 in the first direction X, which is the longitudinal direction, and the fixing fastener 155 may be coupled to the rotation movement member 152 in the second direction Y. Since the rotation movement member 152 is coupled to the shaft 151 and the fixing fastener 155, the rotation movement member 152, the shaft 151, and the fixing fastener 155 may rotate together when the press member 140 rotates. Accordingly, the rotation movement member 152 may move the linear movement member 153 in the first direction, which is the longitudinal direction.

The linear movement member 153 may be provided under the rotation movement member 152 and may move vertically according to the rotation of the rotation movement member 152.

The spring 154 may be provided under the linear movement member 153 to receive a compressive force when the linear movement member 153 moves downward.

The fixing fastener 155 may fasten the shaft 151 and the rotation movement member 152. Although not shown, the pressing member 132 may connect the press member 140 and the shaft 151. Accordingly, when the press member 140 rotates, the rotation movement member 152 may be rotated together.

Due to the components of the hinge device 150 described above, the press member 140 may easily rotate, so that it is possible to more easily remove life creases of the clothes.

Figure 11:
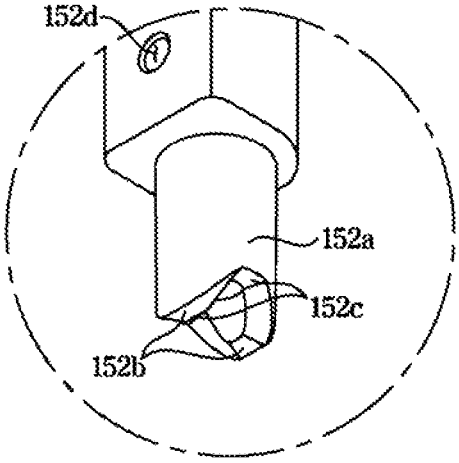
FIG. 11 is an enlarged view showing portion B in the hinge device shown in FIG. 10 according to an embodiment of the present invention.
Figure 12:
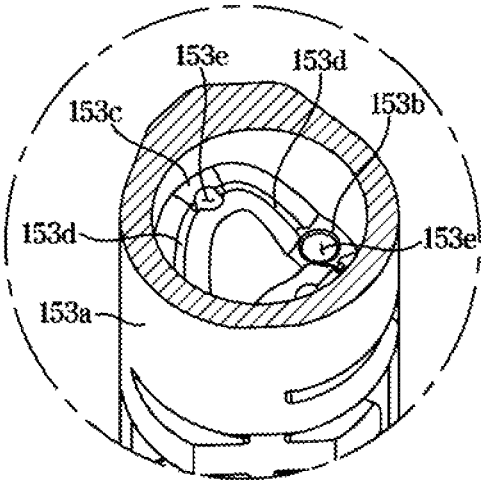
FIG. 12 is an enlarged view showing portion C in the hinge device shown in FIG. 10 according to an embodiment of the present invention.

FIG. 11 is an enlarged view showing portion B in the hinge device shown in FIG. 10. FIG. 12 is an enlarged view showing portion C in the hinge device shown in FIG. 10.

As shown in FIG. 11, the rotation movement member 152 may include an insertion portion 152*a*, a first extension 152*b*, a second extension 152*c*, and a fastener hole 152*d*. The insertion portion 152*a* may be inserted into the cover portion 153*a* of the linear movement member 153.

The first extension 152*b* and the second extension 152*c* may be provided at a lower end of the insertion portion 152*a*. The first extension 152*b* may lengthily extend downward from the insertion portion 152*a*, and the second extension 152*c* may extend to be shorter than the first extension 152*b*. The first extension 152*b* may come into contact with a first curved portion 153*b* of the linear movement member 153, and the second extension 152*c* may come into contact with a second curved portion 153*c*. In the drawing, two first extensions 152*b* and two second extensions 152*c* are shown but the present invention is not limited thereto and the first extension 152*b* and the second extension 152*c* may include various numbers and shapes.

As shown in FIG. 12, the linear movement member 153 may include the cover portion 153*a*, the first curved portion 153*b*, the second curved portion 153*c*, a movement guide 153*d*, and a plurality of accommodation grooves 153*e*.

The cover portion 153*a* may extend upward so that the insertion portion 152*a* of the rotation movement member 152 is inserted therein. Although a cutout part of the cover portion 153*a* is shown in FIG. 12, the cover portion 153*a* may extend upward to be longer. Accordingly, it is possible to prevent lubricant from leaking between the rotation movement member 152 and the linear movement member 153.

The first curved portion 153*b* and the second curved portion 153*c* may be formed inside the cover portion 153*a*. The first curved portion 153*b* may be formed under the second curved portion 153*c* to come into contact with the first extension 152*b*, and the second curved portion 153*c* may be formed above the first curved portion 153*b* to come into contact with the second extension 152*c*.

The plurality of accommodation grooves 153*e* may be formed on each of the first curved portion 153*b* and the second curved portion 153*c*. Each of the plurality of accommodation grooves 153*e* may accommodate the lubricant. It is possible to prevent the lubricant from leaking due to the plurality of accommodation grooves 153*e*.

In addition, the linear movement member 153 may be formed with the movement guide 153*d* through which the lubricant flows so as to facilitate the rotation of the rotation movement member 152. The movement guide 153*d* may be formed inside the cover portion 153*a*.

Figure 13:
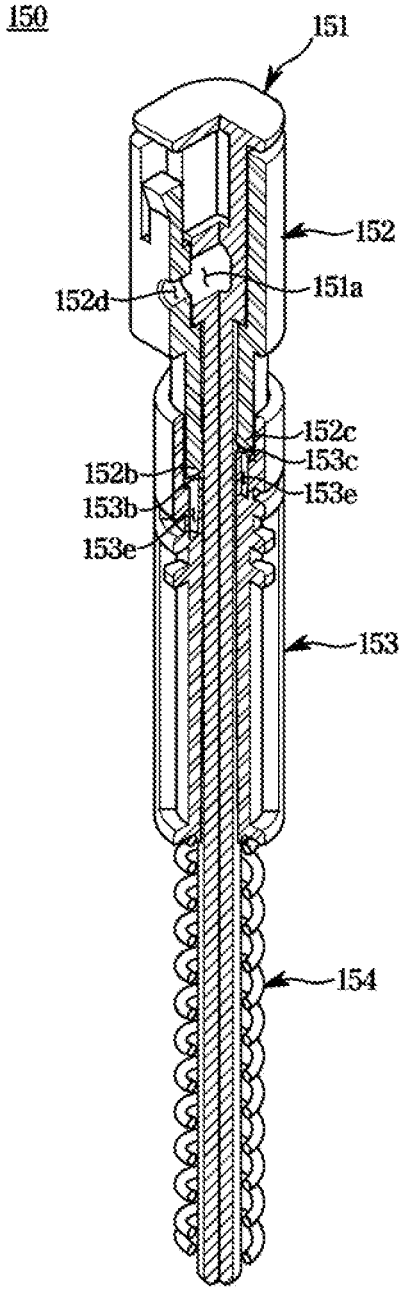
FIG. 13 is a cutout view of the hinge device shown in FIG. 9 according to an embodiment of the present invention.
Figure 14:
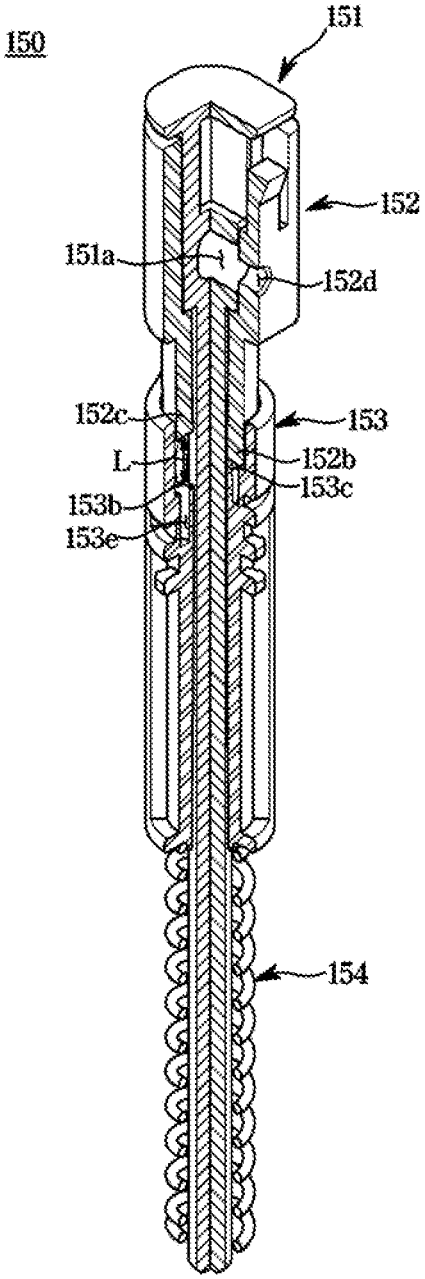
FIG. 14 is a view showing that a shaft shown in FIG. 13 rotates 90 degrees according to an embodiment of the present invention.

FIG. 13 is a cutout view of the hinge device shown in FIG. 9. FIG. 14 is a view showing that a shaft shown in FIG. 13 rotates 90 degrees.

Referring to FIGS. 13 and 14, when the hinge device 150 rotates 90 degrees, the first extension 152*b* and the second curved portion 153*c* may come into contact with each other, and the second extension 152*c* and the first curved portion 153*b* may be spaced apart from each other. At this time, a maximum separation distance L may be formed between the second extension 152*c* and the first curved portion 153*b*. Accordingly, since the spring 154 is compressed as much as the maximum separation distance L, the spring 154 may receive a compressive force. In other words, when the shaft 151 and the rotation movement member 152 rotate 90 degrees, the press member may be rotated by 0 degrees or 180 degrees due to an elastic force of the spring 154.

The shaft 151 may be provided with a shaft hole 151*a* into which the fixing fastener 155 is inserted, and the rotation movement member 152 may also be provided with a fastener hole 152*d* into which the fixing fastener 155 is inserted.

Figure 15:
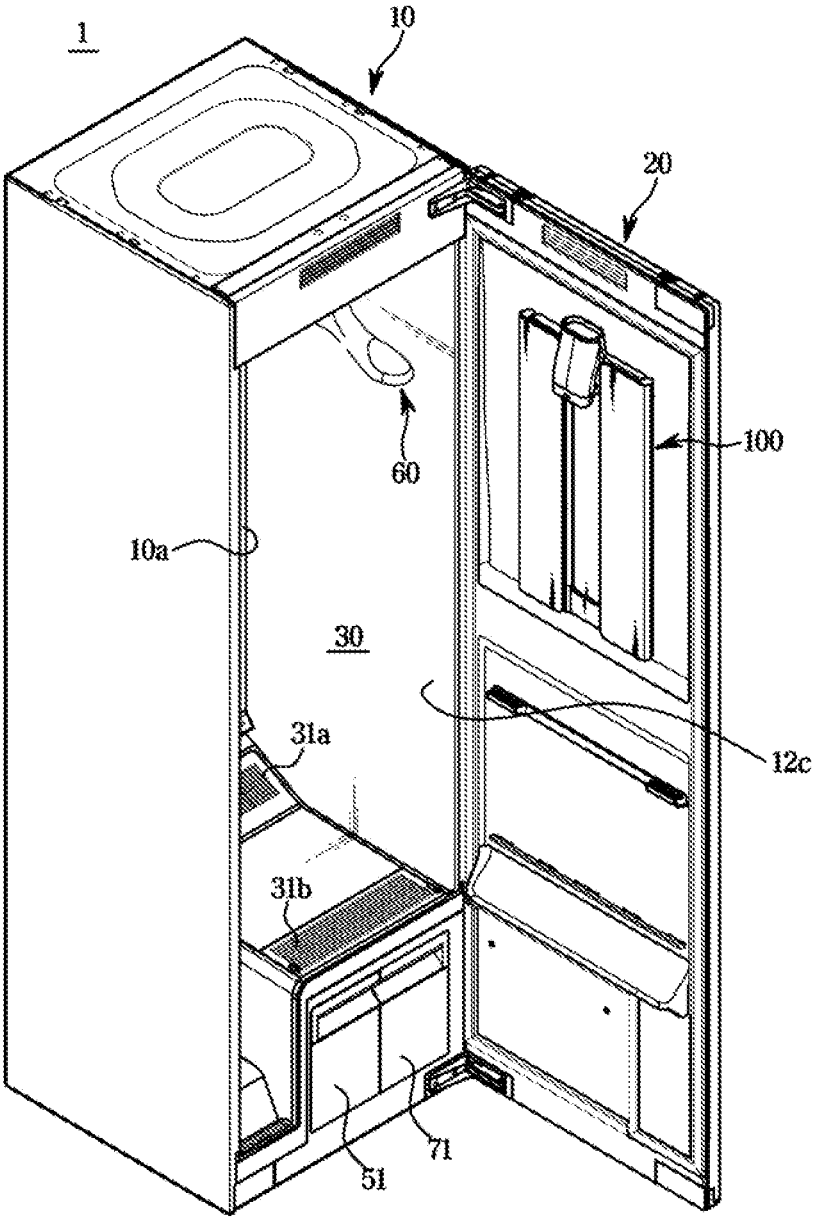
FIG. 15 is a view showing a clothes care device according to another embodiment of the present invention.

FIG. 15 is a view showing a clothes care device according to another embodiment of the present invention.

Referring to FIG. 15, a holder 100 may be coupled to a back surface of a door 20. In other words, a position of the holder 100 is not limited to the inside of a care room 30. In addition, it does go without saying that only the holder 100 may be used alone.

Since the holder 100 may be disposed at various positions such as being attached to the back surface of the door 20, the space utilization of the clothes care device may be increased. In addition, since the holder 100 is not attached to a body 10, a head 110 may be omitted.

Figure 16:
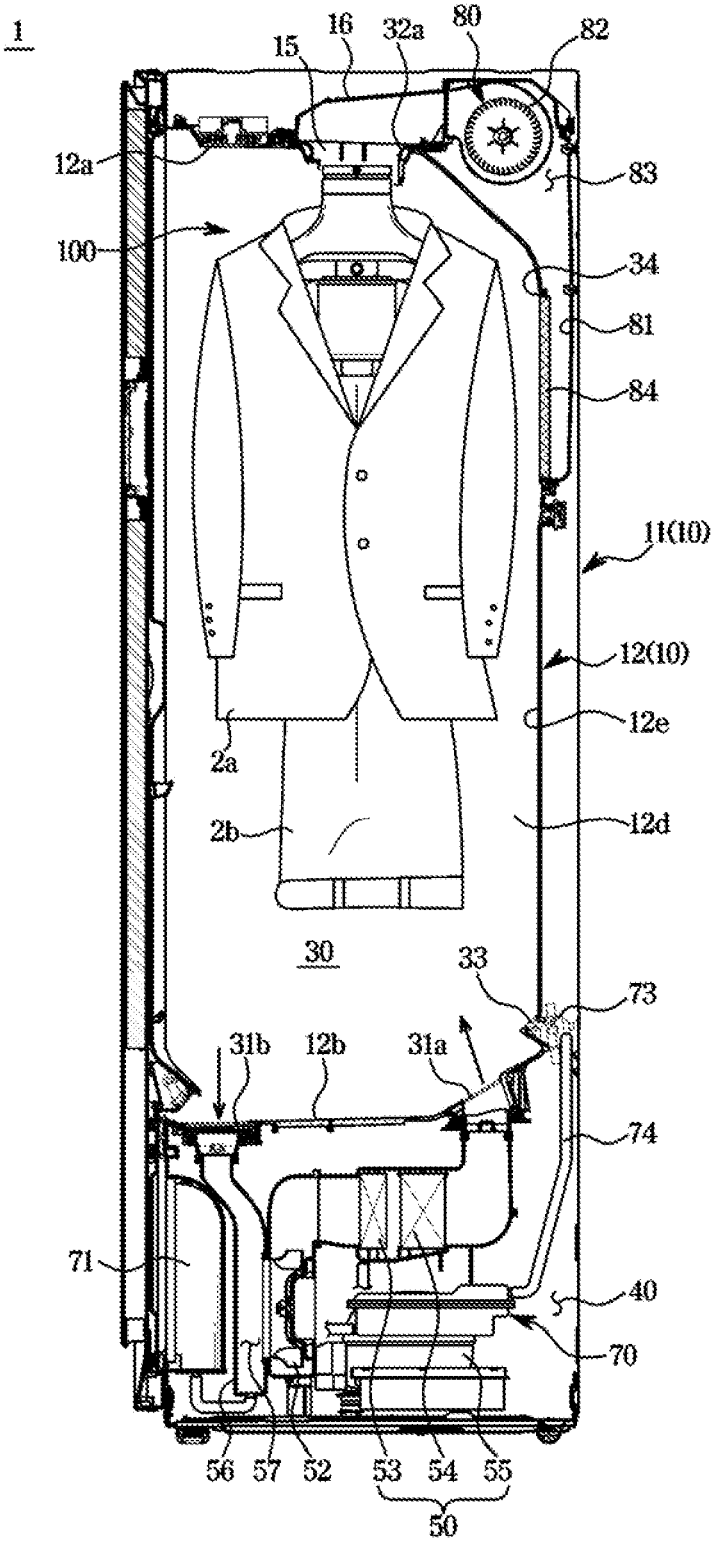
FIG. 16 is a view showing a clothes care device according to still another embodiment of the present invention.
Figure 17:
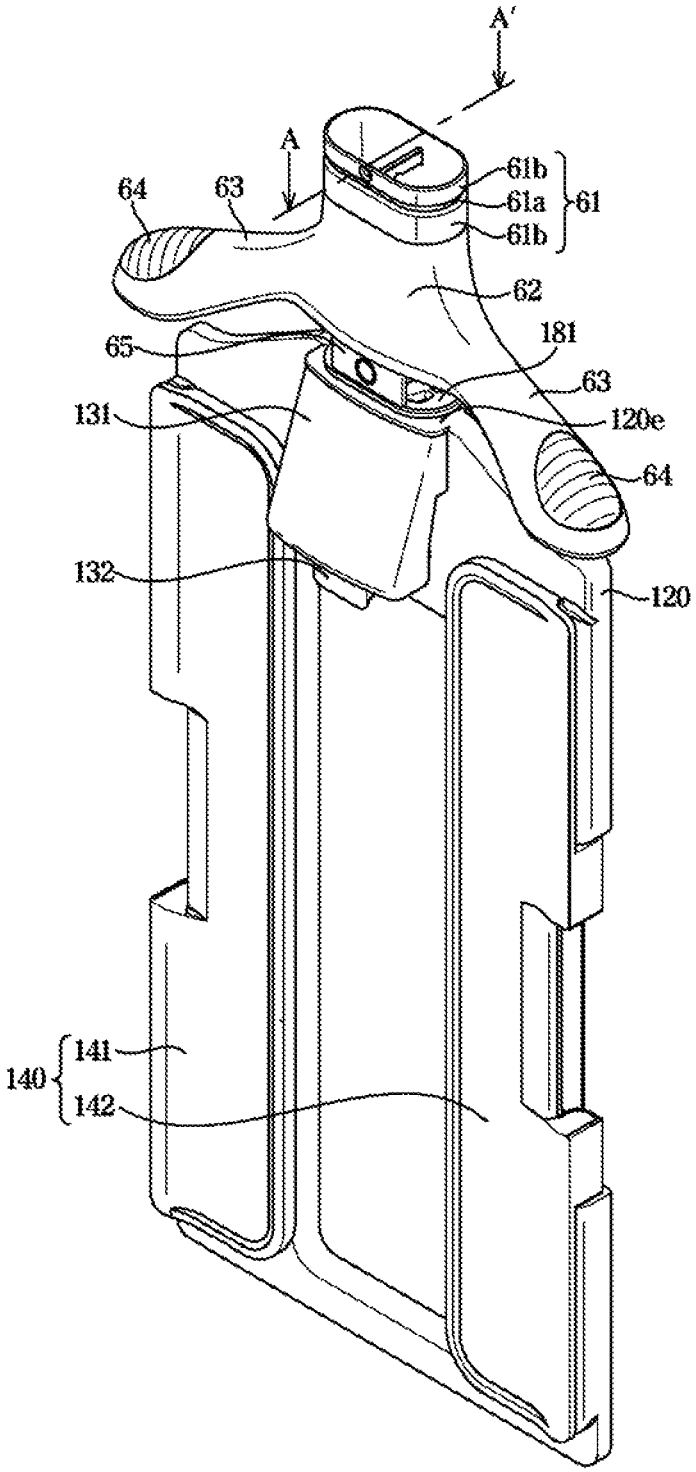
FIG. 17 is a perspective view showing a clothes holder in the clothes care device shown in FIG. 16 according to an embodiment of the present invention.

FIG. 16 is a view showing a clothes care device according to still another embodiment of the present invention. FIG. 17 is a perspective view showing a clothes holder in the clothes care device shown in FIG. 16.

Referring to FIGS. 16 and 17, the clothes care device may further include a holding member 60. The holding member 60 may hold clothes 2*a* and 2*b*. For example, the tops 2*a* may be held on the holding member 60, and the bottoms 2*b* may be held on the holder. However, the type of clothes is not limited to the above example and various types of clothes 2*a* and 2*b* may be held on the holding member 60.

The holding member 60 may include a head portion 61 provided at an upper center to hold the clothes 2*a* and 2*b*, a support body 62 extending downward from the head portion 61, a plurality of holding portions 63 extending from the support body 62 to both sides, and a slip prevention pad 64 attached to upper sides of the plurality of holding portions 63.

The holding member 60 may be coupled to a holder 100. Specifically, the holding member 60 may include a mounting member 65 extending downward from the support body 62 so that the holder 100 is mounted thereon. The mounting member 65 may be coupled to a first rotary member 181 to be described below.

According to the embodiment of the present invention, since the holding member 60 and the holder 100 may be coupled, the tops and the bottoms may be taken care of at the same time. Accordingly, it is possible to increase the user's convenience, and increase the space utilization within the care room.

Figure 18:
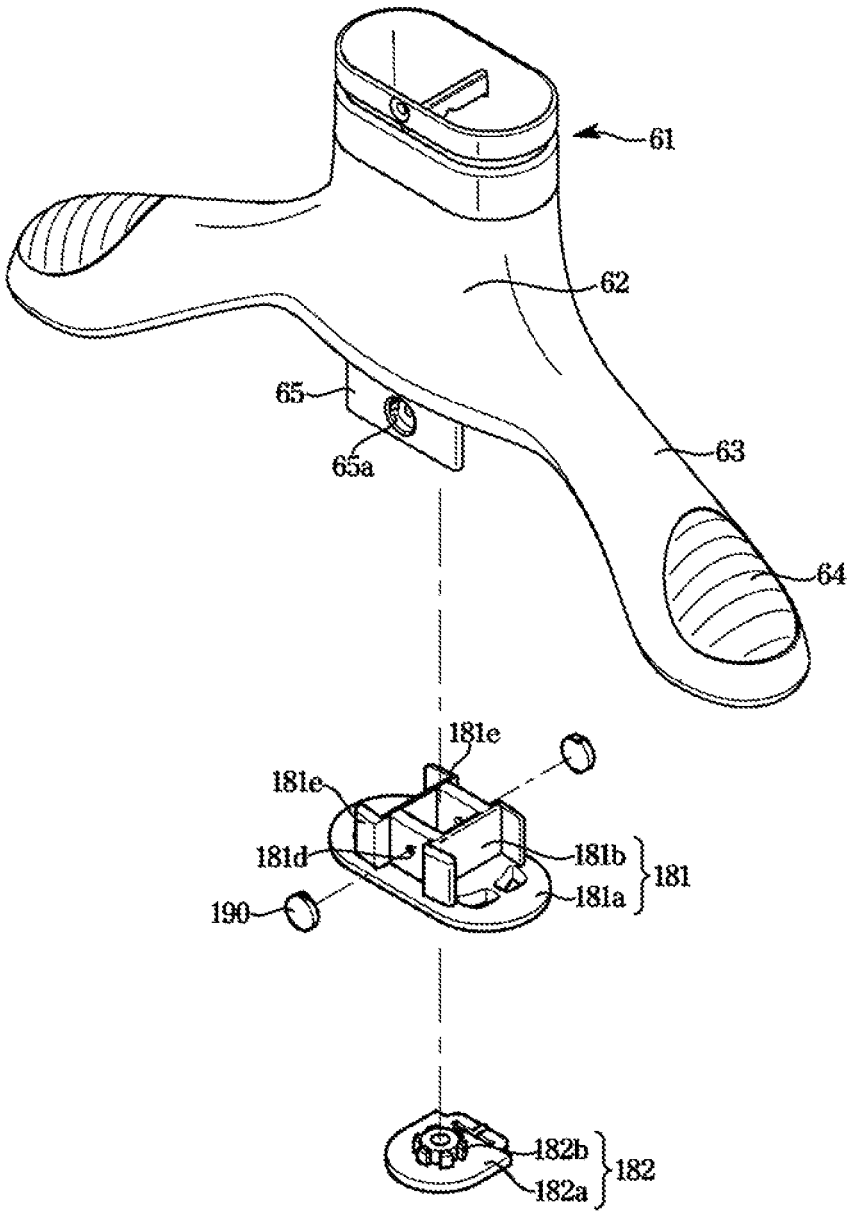
FIG. 18 is an exploded view showing a holding member and a rotary member in the clothes care device shown in FIG. 16 according to an embodiment of the present invention.
Figure 19:
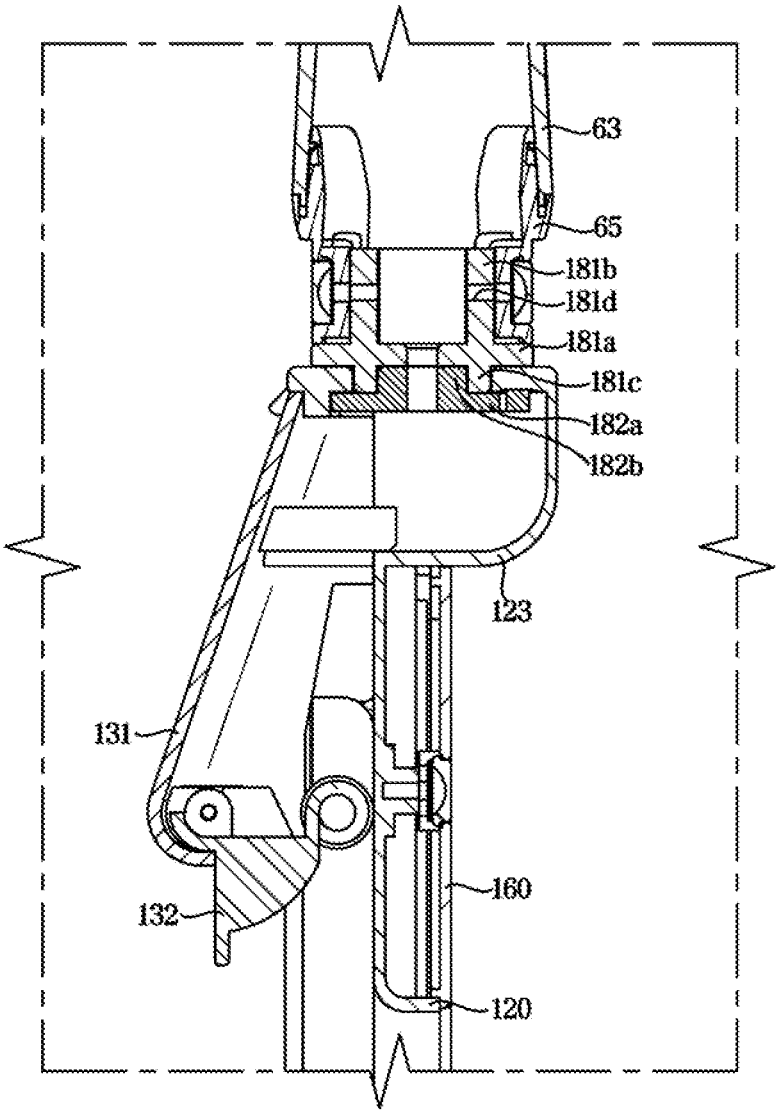
FIG. 19 is a cross-sectional view of the holder and the holding member shown in FIG. 17 taken along line A-A' according to an embodiment of the present invention.

FIG. 18 is an exploded view showing a holding member and a rotary member in the clothes care device shown in FIG. 16. FIG. 19 is a cross-sectional view of the holder and the holding member shown in FIG. 17 taken along line A-A'.

Referring to FIGS. 18 and 19, the mounting member 65 may include a mounting hole 65*a* provided to be coupled to the first rotary member 181. The mounting hole 65*a* may be formed on a central portion of the mounting member 65. However, a position of the mounting hole 65*a* is not limited thereto. The mounting hole 65*a* may be formed in a direction perpendicular to the mounting member 65 so as to be coupled to the first rotary member 181.

The clothes care device may further include a rotary member 180. The rotary member 180 may allow the holding member 60 and the holder 100 to be rotatably coupled. The rotary member 180 may include the first rotary member 181 and a second rotary member 182.

The first rotary member 181 may include a first rotary base 181*a*, a rotary body 181*b*, a first mounting portion 181*c*, a mounting hole 181*d*, and a contact portion 181*e*.

The first rotary base 181*a* may be formed in a shape corresponding to an upper surface of a base so as to be stably seated on the upper surface of the base. An area of the first rotary base 181*a* may be provided to be greater than those of the rotary body 181*b* and the first mounting portion 181*c*.

The rotary body 181*b* may extend upward from the first rotary base 181*a*. The rotary body 181*b* may include a substantially rectangular shape. However, a shape of the rotary body 181*b* is not limited thereto. The mounting hole 181*d* may be formed on the rotary body 181*b*.

The first rotary member 181 may be coupled to the mounting member 65. The first mounting portion 181*c* may protrude downward from the first rotary base 181*a*. The first mounting portion 181*c* may be provided in a shape corresponding to a second mounting portion 182*b* of the second rotary member 182 to be described below. Accordingly, the first mounting portion 181*c* and the second mounting portion 182*b* may be coupled to be rotated integrally. The first mounting portion 181*c* may include a gear shape. However, a shape of the first mounting portion 181*c* is not limited thereto and may include various shapes. The first mounting portion 181*c* may accommodate the second mounting portion 182*b*. However, the present invention is not limited thereto.

The contact portion 181*e* may protrude in a direction from each end of the rotary body 181*b* toward the outside of the rotary body 181*b*. Accordingly, a plurality of contact portions 181*e* may be provided. The contact portion 181*e* may come into contact with an inner surface of the mounting member 65 so that the mounting member 65 and the first rotary member 181 are stably fixed. Accordingly, as the holding member 60 rotates in the holder 100, the rotary member 180 may also stably rotate.

The clothes care device may include a mounting shaft (not shown) passing through the mounting hole 65*a* of the mounting member 65 and the mounting hole 181*d* of the first rotary member 181. The mounting shaft may allow the mounting member 65 and the first rotary member 181 to be coupled.

The second rotary member 182 may include a second rotary base 182*a* and the second mounting portion 182*b*. The second rotary member 182 may be coupled to the first rotary member 181 to be rotated integrally. The second mounting portion 182*b* may protrude upward from the second rotary base 182*a*. The second mounting portion 182*b* may include a gear shape. However, a shape of the second mounting portion 182*b* is not limited thereto and may include various shapes.

The clothes care device may further include a cover member 190. The cover member 190 may be provided to cover the mounting hole 65*a*. One surface 190*a* of the cover member 190 facing the mounting hole 65*a* may be formed to be concave, but an opposite surface 190*b* thereof may be formed to be flat. When the mounting member 65 and the first rotary member 181 are coupled, the cover member 190 may add the beauty to the exterior by covering the mounting hole 65*a*.

Figure 20:
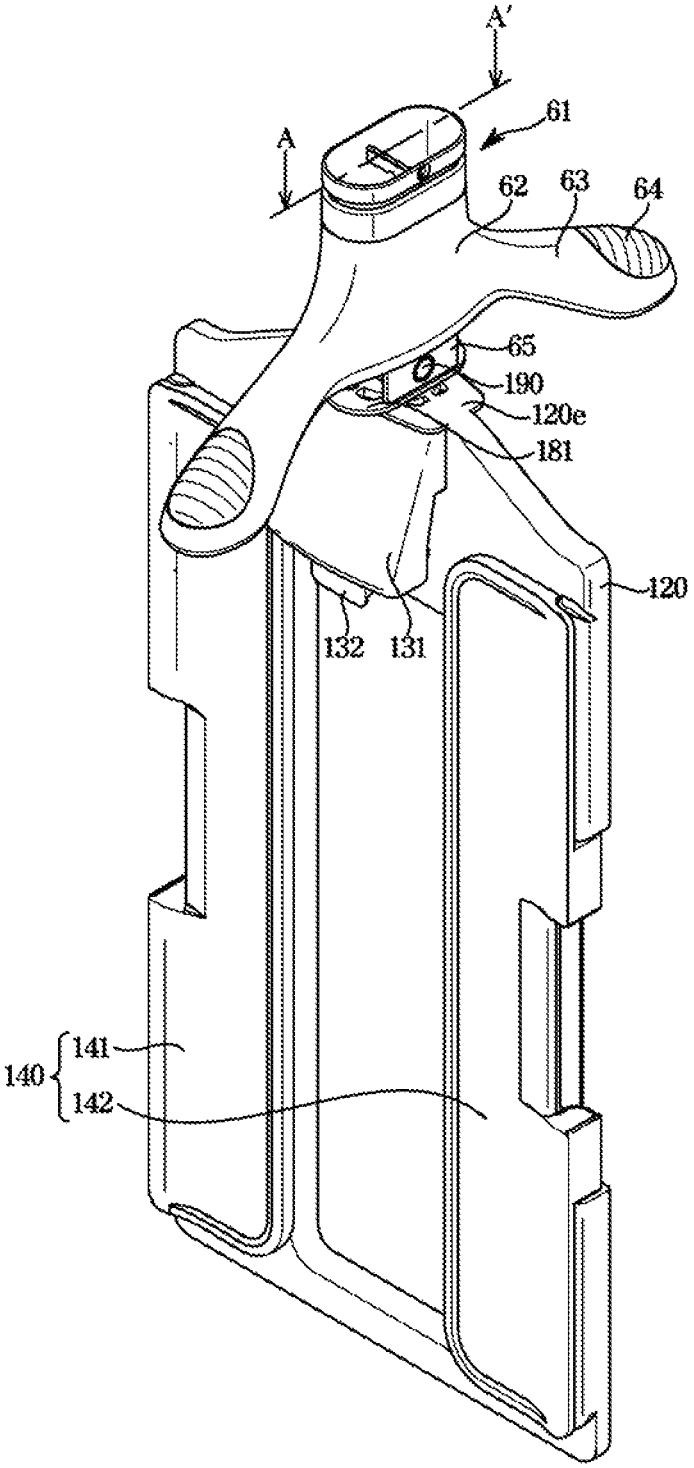
FIG. 20 is a perspective view showing a state in which the holder shown in FIG. 17 is rotated according to an embodiment of the present invention.
Figure 21:
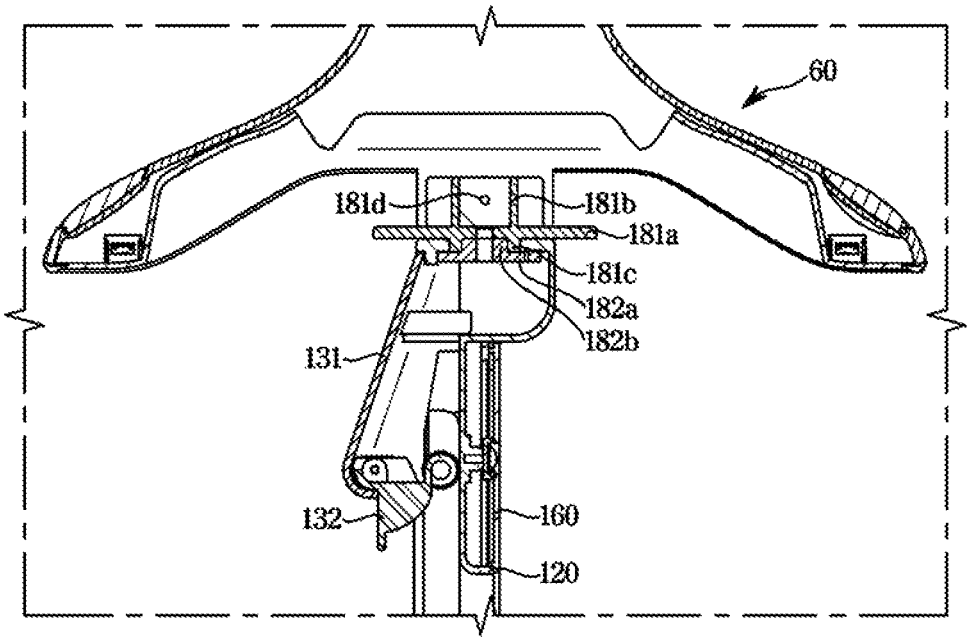
FIG. 21 is a cross-sectional view of the holder and the holding member shown in FIG. 20 taken along line A-A' according to an embodiment of the present invention.

FIG. 20 is a perspective view showing a state in which the holder shown in FIG. 17 is rotated. FIG. 21 is a cross-sectional view of the holder and the holding member shown in FIG. 20 taken along line A-A'.

Referring to FIGS. 20 and 21, the holder 100 and the holding member 60 may be rotatably coupled to each other. Specifically, the holding member 60, the first rotary member 181, and the second rotary member 182 may be coupled to be rotated integrally. The holder 100 and the holding member 60 are rotatable to each other, thereby increasing the user's convenience.

In the drawings, although the holder 100 and the holding member 60 are shown as rotating 90 degrees, a rotational angle is not limited thereto, and the holder 100 and the holding member 60 may rotate to form various angles such as 30 degrees, 45 degrees, and 60 degrees.

Specific embodiments have been shown and described above. However, the present invention is not limited to the above embodiments, and those skilled in the art to which the invention pertains may carry out various changes without departing from the spirit of the invention described in the appended claims.

What is claimed is:

1. A clothes care device comprising:

a body including a care room configured to accommodate clothes; and a holder including a base configured to support clothes accommodated in the care room, and a fixing device coupleable to the base such that while the fixing device is coupled to the base, the clothes supported on the base are between the fixing device and the base, wherein the fixing device includes:

a holder body which couples the fixing device to the base; and a pressing member, rotatably coupleable to the holder body, such that while the pressing member is coupled to the holder body, the pressing member is movable between a first position and a second position, wherein while the pressing member is at the first position, the pressing member is coupled to the holder body and presses the base so that the clothes supported on the base are fixed between the pressing member and the base, and while the pressing member is at the second position the pressing member is decoupled from the holder body and is spaced apart from the base so that the clothes are released from between the pressing member and the base.

2. The clothes care device of claim 1, wherein the holder further includes a head coupleable to and decoupleable from the body.

3. The clothes care device of claim 2, comprising:

a rotary shaft configured to rotatably couple the holder body and the pressing member; and an elastic member coupleable to the rotary shaft to elastically bias the pressing member to the first position.

4. The clothes care device of claim 3, further comprising:

a contact portion at an end opposite to an end of the pressing member to come into contact with the clothes.

5. The clothes care device of claim 4, wherein the fixing device further includes a friction member on the contact portion to increase a frictional force when coming into contact with the clothes.

6. The clothes care device of claim 5, wherein at least a part of the contact portion includes a curved surface to guide the clothes, and the friction member is on an outer circumferential surface of the contact portion.

7. The clothes care device of claim 4, wherein the holder body is disposed on an upper portion of the pressing member, and a center of the rotary shaft is positioned under a center of the contact portion so as to allow the clothes to be introduced between the holder body and the pressing member.

8. The clothes care device of claim 1, further comprising a door rotatably coupleable to the body to open and close the care room, wherein the holder is coupleable to and decoupleable from the door.

9. A clothes care device, comprising:

a body including a care room configured to accommodate clothes; and a holder including:

a base configured to support clothes accommodated in the care room, a fixing device configured to fix the clothes while the clothes are supported on the base, a plurality of press members rotatably coupleable to both sides of the base, the plurality of press members being configured to apply pressure to the clothes, and the base and the plurality of press members including magnets to press the clothes, wherein the fixing device includes:

a holder body coupleable to the base; and a pressing member rotatably coupleable to the holder body, wherein while the pressing member is coupled to the holder body, the pressing member is movable between a first position at which the pressing member presses the base so that the clothes supported the base are fixed between the pressing member and the base and a second position at which the pressing member is spaced apart from the base so that the clothes are released from between the pressing member and the base.

10. The clothes care device of claim 9, wherein the holder further includes a plurality of hinge devices, each of the plurality of hinge devices includes:

a shaft configured to connect the base and one of the plurality of press members, the shaft formed to extend along a longitudinal direction;

a rotation movement member coupleable to the shaft and be rotatable together with the shaft;

a linear movement member coupleable to the rotation movement member, the linear movement member being configured to move along the longitudinal direction in response to a rotation of the rotation movement member; and a spring elastically biased to the linear movement member, and the linear movement member includes:

a cover portion formed to extend along a longitudinal direction of the linear movement member to cover the rotation movement member; and an accommodation groove recessed along the longitudinal direction of the linear movement member so that the linear movement member accommodates lubricant.

11. The clothes care device of claim 1, further comprising a holding member inside the care room and configured to hold the clothes, wherein the holding member is coupleable to an upper side of the holder.

12. The clothes care device of claim 11, further comprising:

a first rotary member coupleable to a lower side of the holding member, and a second rotary member coupleable to the first rotary member on the upper side of the holder, wherein the holder and the holding member are rotatably coupleable to each other.

13. The clothes care device of claim 12, wherein the first rotary member includes a first rotary base, and a first mounting portion formed to protrude downward from the first rotary base, the second rotary member includes a second rotary base, and a second mounting portion formed to protrude upward from the second rotary base to be coupleable to the first mounting portion, and the first mounting portion and the second mounting portion are provided in shapes corresponding to each other.

14. The clothes care device of claim 1, wherein the fixing device is adjacent to a clothes supporter configured to support the clothes on the base, and a lower portion of the base includes a stepped portion having a step difference with the base to prevent creases of the clothes.

15. The clothes care device of claim 2, further comprising:

a support device equipped with the head of the holder so that the holder is disposed within the care room, wherein the head includes a mounting groove mounted on the support device.

* * * * *